US008209991B2

(12) United States Patent
Kondou et al.

(10) Patent No.: US 8,209,991 B2
(45) Date of Patent: Jul. 3, 2012

(54) COOLING STORAGE AND METHOD OF OPERATING THE SAME

(75) Inventors: Naoshi Kondou, Toyoake (JP); Akihiko Hirano, Toyoake (JP); Masahide Yatori, Toyoake (JP); Shinichi Kaga, Toyoake (JP); Hideyuki Tashiro, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 489 days.

(21) Appl. No.: 12/529,594

(22) PCT Filed: Mar. 13, 2007

(86) PCT No.: PCT/JP2007/054891

§ 371 (c)(1),
(2), (4) Date: Sep. 2, 2009

(87) PCT Pub. No.: WO2008/111162

PCT Pub. Date: Sep. 18, 2008

(65) Prior Publication Data

US 2010/0115973 A1 May 13, 2010

(51) Int. Cl.
*F25B 1/00* (2006.01)

(52) U.S. Cl. ..... 62/115; 62/441

(58) Field of Classification Search ..... 62/115, 62/441, 498, 126, 129; 700/275
See application file for complete search history.

(56) References Cited

U.S. PATENT DOCUMENTS 4,569,206 A * 2/1986 Mitani et al. ..... 62/156
5,156,016 A * 10/1992 Day ..... 62/199
5,228,308 A * 7/1993 Day et al. ..... 62/198
5,477,915 A * 12/1995 Park ..... 165/206
5,678,416 A * 10/1997 Yoo et al. ..... 62/180
5,722,248 A * 3/1998 Suh ..... 62/180
5,732,561 A * 3/1998 Kim ..... 62/89
5,845,503 A * 12/1998 Choi ..... 62/89
6,427,463 B1 * 8/2002 James ..... 62/186

(Continued)

FOREIGN PATENT DOCUMENTS

JP 62-22396 5/1983

(Continued)

OTHER PUBLICATIONS

International Search Report dated Apr. 24, 2007 for International Application No. PCT/JP2007/054891.

*Primary Examiner* — Mohammad Ali
(74) *Attorney, Agent, or Firm* — Wenderoth, Lind & Ponack, L.L.P.

(57) ABSTRACT

The liquid refrigerant from the compressor 20 and the condenser 21 is alternately supplied to the cooling device for the freezing room 27F and the evaporator for the refrigeration room 27R through the three-way valve 24, so that the freezing room and the refrigeration room are alternately cooled. Here, the ratio of the refrigerant supply time to each evaporator is controlled based not on a deviation between a target temperature set for each storage room and an actual storage room temperature measured in each storage room, but on an integrated value obtained by integrating the difference of these deviations. In a cooling storage, in which from one compressor a refrigerant is selectively supplied to multiple evaporators respectively disposed in multiple storage rooms of varied thermal loads, a one-storage room cooling mode is prevented from being unnecessarily switched to a alternate cooling mode.

15 Claims, 14 Drawing Sheets

U.S. PATENT DOCUMENTS

| | | | | |
|---|---|---|---|---|
| 6,460,357 | B1 * | 10/2002 | Doi et al. | 62/199 |
| 6,526,769 | B2 * | 3/2003 | Kim | 62/199 |
| 6,715,305 | B2 * | 4/2004 | Doi et al. | 62/180 |
| 7,152,415 | B2 * | 12/2006 | Micak et al. | 62/157 |

FOREIGN PATENT DOCUMENTS

| | | |
|---|---|---|
| JP | 60-188982 | 12/1985 |
| JP | 05-071815 | 3/1993 |
| JP | 2000-146400 | 5/2000 |
| JP | 2000-230766 | 8/2000 |
| JP | 2001-272114 | 10/2001 |
| JP | 2002-22336 | 1/2002 |
| JP | 2003-028553 | 1/2003 |
| JP | 2004-101143 | 4/2004 |
| JP | 2005-121341 | 5/2005 |
| JP | 2005-127654 | 5/2005 |
| JP | 2006-146298 | 6/2006 |
| JP | 2007-71520 | 3/2007 |

* cited by examiner

COOLING STORAGE AND METHOD OF OPERATING THE SAME

TECHNICAL FIELD

The present invention relates to a cooling storage which comprises multiple evaporators and supplies a refrigerant to these evaporators from one compressor, and an operating method of the same.

BACKGROUND ART

As one of this kind of cooling storages, for example, Patent literature 1 as below has been disclosed, in which heat insulating freezing room and refrigeration room are partitioned in a heat insulation storage body, while an evaporator is provided in each room, so that a refrigerant is alternately supplied to each of these evaporators from one compressor to produce cooling action.

In this kind of refrigerator, a refrigerant is compressed by the compressor and then liquefied by the condenser, so as to be alternately supplied to the evaporator for freezing room and the evaporator for refrigeration room that are connected to the exit side of a three-way valve respectively via a capillary tube. At the time of so-called a control operation wherein a regular cooling operation is conducted within the temperature range close to a set temperature, for example, when the temperature in the cooling room reached the OFF temperature, the three-way valve is switched to the cooling mode for the other room, and then, the compressor is stopped when detected temperatures in both rooms reached the OFF temperature or below.

According to this configuration, in the above-mentioned control operation, when an user stores a food of high temperature in one storage room, this storage room is sufficiently cooled before the cooling is switched to the other storage room, and thus, it is advantageous that the newly stored food can be sufficiently cooled.

However, in the above configuration, when a food of high temperature is stored in both the storage rooms, there occurs a problem that the food in the storage room to be cooled on ahead would have no trouble, whereas the food in the other storage room to be cooled later would not be able to be cooled early enough.

In response to such a circumstance, for example, Patent Literature 2 has suggested an art in which a control device alternately switches both the storage rooms at a predetermined time ratio. Here, for example, when temperatures in both the storage rooms in the refrigeration room and the freezing room surpassed the ON temperature, an alternate cooling mode is executed for alternately switching the cooling between the freezing room and the refrigeration room at a ratio of for example 30:20 minutes. Furthermore, when the temperature in the freezing room still rises since the cooling performance is not sufficient, and when inside the freezing room reached a prescribed temperature (for example, −12 degrees), the above time ratio is changed to the one prioritizing the freezing room side (for example, 40:20 minutes), so as to suppress the rise of the temperature inside the freezing room.

[Patent Literature 1]: Japanese Unexamined Utility Model Publication No. S60-188982

[Patent Literature 2]: Japanese Unexamined Patent Publication No. 2002-22336

However, even with the above configuration, the cooling is immediately switched to the alternate cooling mode, when, for example, the cooling mode was switched to the freezing room cooling mode since a food of high temperature was stored in the freezing room and caused the temperature inside the room to rise above the ON temperature, and after that, this time, the door of the refrigeration room is opened and closed frequently, causing the temperature inside the room to rise above the ON temperature even temporarily. This delays the cooling of the freezing room since apart of the cooling performance is spared for cooling the refrigeration room, and eventually, the temperature rise within the freezing room cannot be sufficiently suppressed.

And also, when conducting so-called a pull-down operation, not a normal control operation, for cooling the storage room temperature from the one close to the room temperature down to around a set temperature, and when the alternate cooling mode is performed at the above long cycle of 30:20 minutes, the cooling operation of the storage room temperature at a predetermined temperature curve cannot be conducted, and thus, there occurs variations in the cooling performance according to specifications such as the volume of the storage body. But then again, if the switching in the alternate cooling mode is conducted at a short cycle such as, for example, 3:2 minutes, the problem of sparing the cooling performance for the refrigeration room becomes unfavorably prominent even when a quick cooling of the freezing room as mentioned above is required.

The present invention has been completed based on the above circumstances, and its purpose is to provide a cooling storage and an operating method of the same, in which from one compressor a refrigerant is selectively supplied to multiple evaporators respectively disposed in multiple storage rooms of varied thermal loads, and is capable of preventing a one-storage room cooling mode to be unnecessarily switched to the alternate cooling mode, and moreover, of executing a pull-down operation at a predetermined temperature curve.

DISCLOSURE OF THE INVENTION

In order to achieve the above-mentioned objectives, the operating method according to the present invention is for a cooling storage which comprises a compressor, a condenser, a valve device, a first and a second evaporators, and a throttle device for throttling a refrigerant flowing into each the evaporator, wherein the refrigerant that has been compressed by the compressor and liquified by the condenser is selectively supplied to the first and the second evaporators by the valve device, so that each of a first and a second storage rooms of varied thermal loads is cooled by the first and the second evaporators, and is characterized by calculating and integrating a deviation between a target temperature set for each the first and the second storage room and an actual storage temperature measured in each storage room at every predetermined time, and changing the ratio of refrigerant supply time for each of the first and the second evaporators by controlling the valve device based on the integrated value.

Such control method can be performed by a cooling storage comprising the followings:

a refrigerating cycle comprising the following A1 to A6;

(A1) a compressor for compressing a refrigerant (A2) a condenser for releasing heat from the refrigerant compressed by the compressor (A3) a valve device, with its entrance connected with the condenser side while its two exits connected with a first and a second refrigerant supply channels, and capable of flow channel switching motion for selectively connecting the entrance side with any one of the first and the second refrigerant supply channels (A4) a first and a second evaporators provided respectively in the first and the second refrigerant supply channels (A5) a throttle device for throttling a refrigerant flowing into each evaporator (A6) a refrigerant circulating channel which connects from the refrigerant exit sides of the first and the second evaporators to the refrigerant sucking side of the compressor a storage body having a first and a second storage rooms of varied thermal loads which are cooled with cold air produced by the first and the second evaporators, a target temperature setter for setting a target temperature for each of the first and second storage rooms, a first and a second temperature sensors for detecting a storage room temperature inside each storage room, a device temperature deviation calculator for calculating for each storage room a temperature deviation as a difference between each target temperature of each storage room set in the target temperature setter and a storage room temperature of each storage room detected by each temperature sensor, an integrator of device temperature deviation between rooms for calculating and integrating a temperature deviation between rooms as a difference for every storage room with respect to a temperature deviation calculated by the device temperature deviation calculator, and a valve controller for changing an opening ratio of each of the first and the second refrigerant supply channels in the valve device by comparing an integrated value integrated by the integrator of device temperature deviation between rooms with a reference value.

And also, the present invention may be constituted as a cooling storage comprising the following configurations.

a refrigerating cycle comprising the following A1 to A6;

(A1) a compressor driven by an inverter motor for compressing a refrigerant (A2) a condenser for releasing heat from the refrigerant compressed by the compressor (A3) a valve device, with its entrance connected with the condenser side while its two exits connected with a first and a second refrigerant supply channels, and capable of flow channel switching motion for selectively connecting the entrance side with any one of the first and the second refrigerant supply channels (A4) a first and a second evaporators provided respectively in the first and the second refrigerant supply channels (A5) a throttle device for throttling the refrigerant flowing into each evaporator (A6) a refrigerant circulating channel which connects from the refrigerant exit sides of the first and the second evaporators to a refrigerant sucking side of the compressor a storage body having a first and a second storage rooms of varied thermal loads which are cooled with cold air produced by the first and the second evaporators, a target temperature setter for setting a target temperature for each of the first and second storage rooms, a first and a second temperature sensors for detecting a storage room temperature inside each storage room, a device temperature deviation calculator for calculating for each storage room a temperature deviation as a difference between each target temperature of each storage room set in the target temperature setter and a storage room temperature of each storage room detected by each temperature sensor, an integrator of device temperature deviation between rooms for calculating and integrating a temperature deviation between rooms as a difference for every storage room with respect to a temperature deviation calculated by the device temperature deviation calculator, a valve controller for changing an opening ratio of each of the first and the second refrigerant supply channels in the valve device by comparing an integrated value integrated by the integrator of device temperature deviation between rooms with a reference value, a temperature deviation accumulated value calculator for calculating a temperature deviation accumulated value as an accumulated value of the sum for every storage room with respect to a temperature deviation calculated by the device temperature deviation calculator, and a rotational speed controller for changing the rotational speed of the inverter motor by comparing an accumulated value calculated by the temperature deviation accumulated value calculator with a reference value.

According to the present invention, the ratio of the refrigerant supply time to each of the first and second evaporators is controlled based not on a deviation between a target temperature set for each of the first and the second storage rooms and an actual storage room temperature measured in each storage room, but on the integrated value obtained by integrating the difference of these deviations. Accordingly, even when, for example, the door is temporarily opened and the external air flows into the storage room, causing the storage room temperature to be temporarily rise, the one-storage room cooling mode can be prevented from unnecessarily shifting to the alternate cooling mode since no rapid change appears in the integrated value of temperature deviations. Moreover, the alternate cooling mode can be repeated at a short cycle, and thereby providing a cooling storage and an operating method thereof capable of executing the pull-down operation at a predetermined temperature curve.

DESCRIPTION OF SYMBOLS

Figure 1:
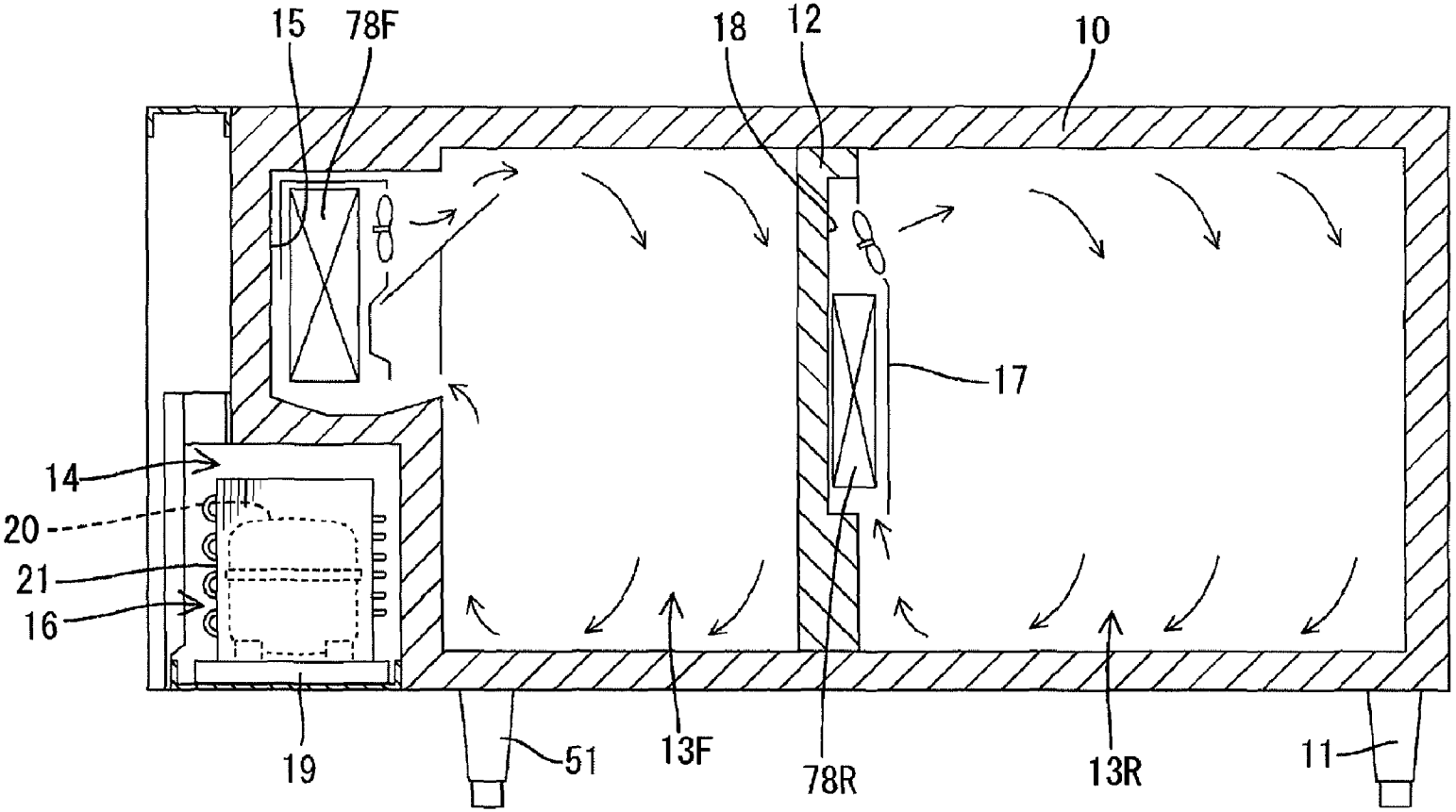
FIG. 1 is a cross-sectional view showing the entirety of Embodiment 1 of the present invention.

10 . . . storage body 20 . . . compressor 21 . . . condenser 24 . . . three-way valve (valve device) 25F and 25R . . . first and second refrigerant supply channel 26F and 26R . . . capillary tube (throttle device) 27F . . . freezing room evaporator (first evaporator) 27R . . . refrigeration room evaporator (second evaporator) 31 . . . refrigerant circulating channel 40 . . . refrigerating cycle 50 . . . refrigerating cycle control circuit 51F . . . temperature sensor (first temperature sensor) 51R . . . temperature sensor (second temperature sensor) and 80 . . . target temperature setter 56 . . . temperature deviation calculating means 57 . . . integrating means of temperature deviation between rooms 58 . . . valve control means 60 . . . rotational speed control means 70 . . . calculating means of temperature deviation accumulated value 81 . . . memory means 100 . . . memory means 101 . . . table reading means 102 . . . clocking means

BEST MODE FOR CARRYING OUT THE INVENTION

[Embodiment 1 ]

As referring now to FIGS. 1 to 6, Embodiment 1 according to the present invention is described. The present Embodiment 1 is illustrated by example by being applied to a commercial lateral (table type) refrigerator freezer, and its entire structure is described as referring firstly to FIG. 1. The symbol 10 represents a storage body, composed of a heat insulating box body that is horizontally long and opening in the front surface and supported by legs 11 provided in four corners on the bottom surface. The inside of the storage body 10 is divided into right and left sides by a heat insulating and post-installing partition wall 12, and the relatively narrower left side is a freezing room 13F corresponding to a first storage room, while the relatively wider right side is a refrigeration room 13R corresponding to a second storage room. In addition, though not shown, a heat insulating door is attached to the opening on the front surface of the freezing room 13F and the refrigeration room 13R, so as to be opened and closed.

Provided in the left side when viewed from the front of the storage body 10 is a mechanical room 14. A heat insulating evaporator room 15 for the freezing room 13F which is connected with the freezing room 13F is protrudingly provided in the back of the upper part within the mechanical room 14, and a duct 15A and an evaporator fan 15B are provided therein. While in the lower part thereof, a compressor unit 16 is removably housed. And also, an evaporator room 18 for the refrigeration room 13R is formed on the surface of the partition wall 12 in the side of the refrigeration room 13R by stretching the duct 17, and the evaporator fan 18A is provided therein.

The compressor unit 16 is provided with a compressor 20 for compressing a refrigerant by being driven at a constant speed by a motor not shown and a condenser 21 connected with the refrigerant discharging side of the compressor 20, both disposed on a base 19, so as to be taken in and out of the mechanical room 14. A condenser fan 22 (shown only in FIG. 2) for air-cooling the condenser 21 is also mounted in the compressor unit 16.

Figure 2:
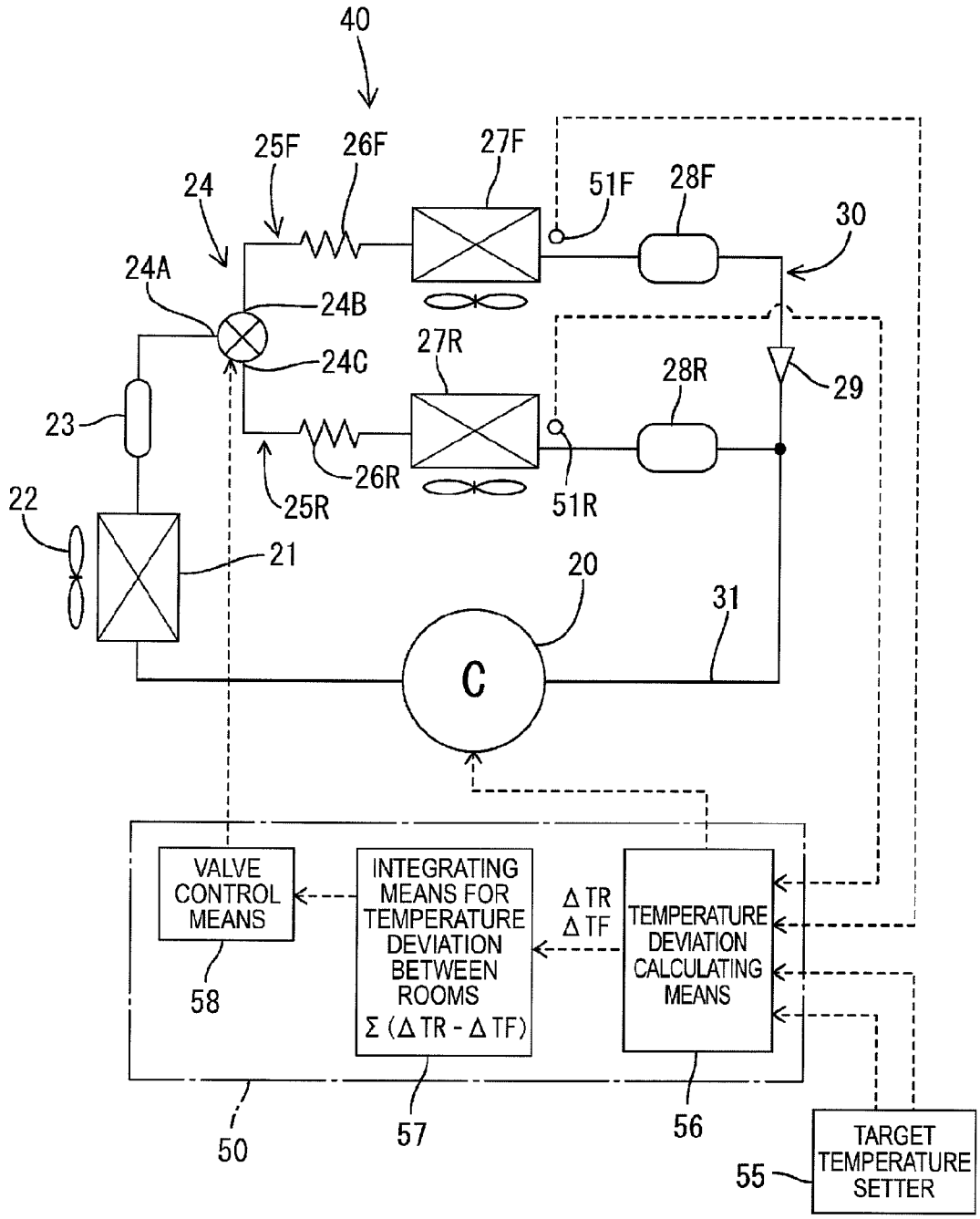
FIG. 2 is a block diagram of a refrigerating cycle according to Embodiment 1.

As shown in FIG. 2, the exit side of the condenser 21 is connected with an entrance 24A of a three-way valve 24 as a valve device via a drier 23. The three-way valve 24 has one entrance 24A and two exits 24B and 24C, and these exits 24B and 24C are respectively continued to a first and a second refrigerant supply channels 25F and 25R. This three-way valve 24 is capable of the flow channel switching motion for selectively connecting the entrance 24A with any one of the first and the second refrigerant supply channels 25F and 25R.

A capillary tube 26F in the freezing room side corresponding to the throttle device and an evaporator for freezing room 27F (the first evaporator) housed within the evaporator room 15 in the side of the freezing room 13F are provided in the first refrigerant supply channel 25F. And also, a capillary tube 26R in the refrigeration room side corresponding also to the throttle device and an evaporator for refrigeration room 27R (the second evaporator) housed within the evaporator room 18 in the side of the refrigeration room 13R are provided in the second refrigerant supply channel 25R. The refrigerant exits of both the cooling devices 27F and 27R are commonly and sequentially connecting an accumulator 28F, a check valve 29, and an accumulator 28R, while being provided with a refrigerant circulating channel 31 branched off from the downstream side of the check valve 29 and continued to the sucking side of the compressor 20. The above-mentioned refrigerant circulating channel running from the discharging side back to the sucking side of the compressor 20 composes a known refrigerating cycle 40 for supplying the refrigerant from one compressor 20 to two evaporators 27F and 27R, and capable of shifting the supplying destination of a liquid refrigerant by the three-way valve 24.

The above-mentioned compressor 20 and the three-way valve 24 are controlled by a refrigerating cycle control circuit 50 having a built-in CPU. This refrigerating cycle control circuit 50 is given signals from a temperature sensor 51F corresponding to the first temperature sensor for detecting the air temperature inside the freezing room 13F and from a temperature sensor 51R corresponding to the second temperature sensor for detecting the air temperature inside the refrigeration room 13R. On the other hand, the refrigerating cycle control circuit 50 is provided with a target temperature setter 55 in which target temperatures of the freezing room 13F and the refrigeration room 13R can be set by an user, and in accordance with the setting operation thereof, the target temperatures TFa and TRa along with the upper limit set temperatures TF(ON) and TR(ON) and the lower limit set temperatures TF(OFF) and TR(ON) of each of the storage rooms 13F and 13R are decided, so that signals corresponding to these values are given to the refrigerating cycle control circuit 50.

In the refrigerating cycle control circuit 50, the operation of the compressor 20 is started to begin the cooling operation when a detected temperature TF of the temperature sensor 51F is higher than the upper limit set temperature TF(ON) of the freezing room 13F, or when a detected temperature TR of the temperature sensor 51R is higher than the upper limit set temperature TR(ON) of the refrigeration room 13F, whereas the operation of the compressor 20 is stopped when both the detected temperatures TF and TR fall below the lower limit set temperatures TF(OFF) and TR(OFF) of each the freezing room 13F and the refrigeration room 13R.

Furthermore, the refrigerating cycle control circuit 50 is provided with a device temperature deviation calculator 56 for calculating a F room temperature deviation ΔTF as a difference (TF−TFa) between the target temperature TFa of the freezing room 13F set in the target temperature setter 55 and the actual storage room temperature TF of the freezing room 51F detected by the temperature sensor 51F, as well as a R room temperature deviation ΔTR as a difference (TR−TRa) between the target temperature TRa of the refrigeration room 13R set in the target temperature setter 55 and an actual storage room temperature TR of the refrigeration room 51R detected by the temperature sensor 51R. In addition, an integrator of device temperature deviation between rooms 57 is also provided for calculating "temperature deviation between rooms" as a difference (ΔTR−ΔTF) of each calculated temperature deviation ΔTF and ΔTR, and integrating the "temperature deviation between rooms" only for a prescribed time (for example, for 5 minutes). Then, according to the integrated value of this integrator of device temperature deviation between rooms 57, the valve controller 58 controls the opening ratio of the three-way valve 24 in each of the first and the second refrigerant supply channels 25F and 25R. In particular, the opening ratio of both the above refrigerant supply channels 25F and 25R are controlled so that the ratio R (the second refrigerant supply channel 25R):F (the first refrigerant supply channel 25F) as a default value becomes 3:7. In other words, the cooling time ratio of the refrigeration room 13R (R room cooling time ratio) is 0.3, and furthermore the R room cooling time ratio is changeable by 0.1 in a range from 0.1 to 0.9. Additionally, the above device temperature deviation calculator 56, the integrator of device temperature deviation between rooms 57, and the valve controller 58 are composed of CPU in which a prescribed software is executed, and their concrete control modes are as shown in the flow charts in FIGS. 3 and 4, described along with the action of the present embodiment in the following.

Figure 3:
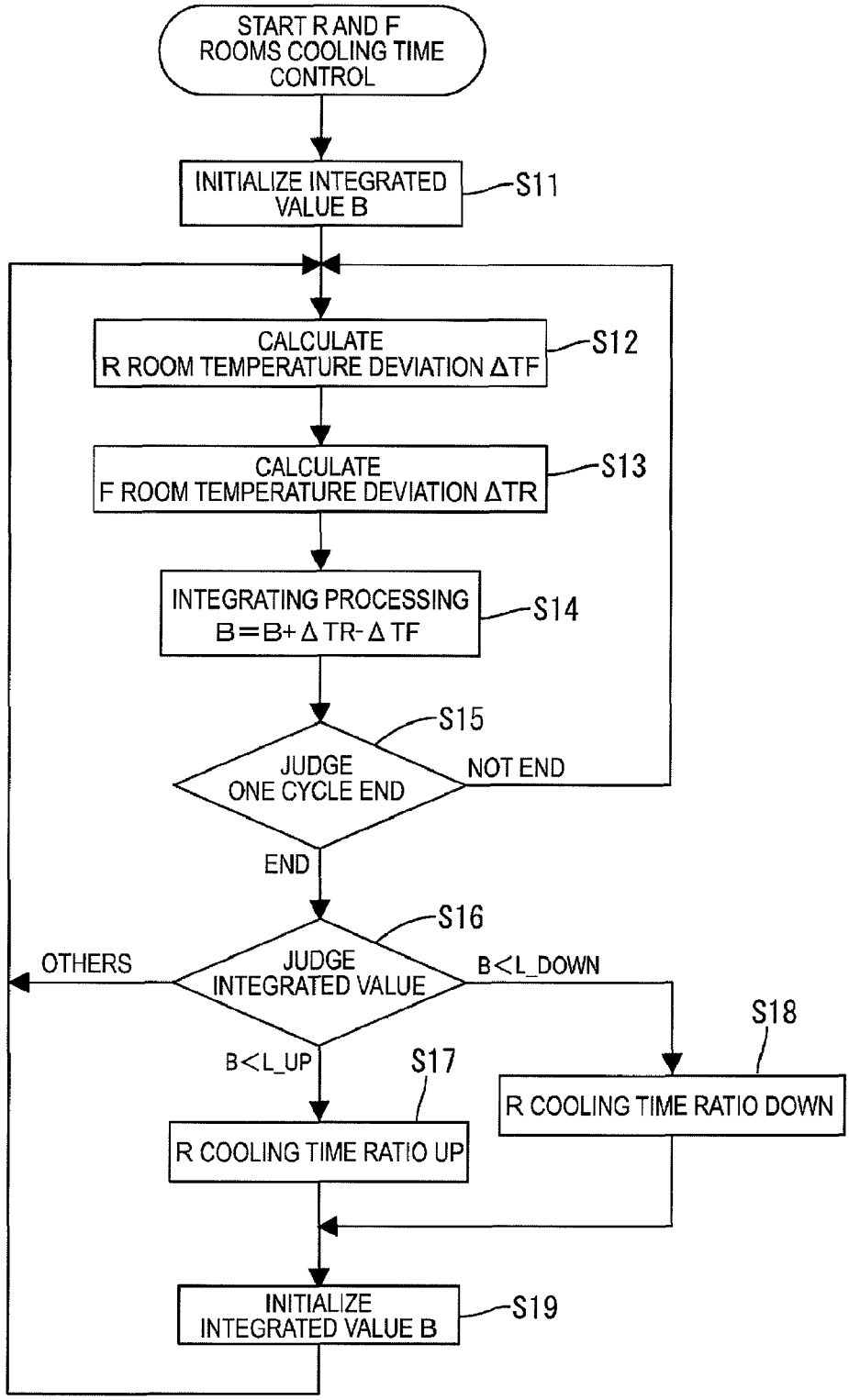
FIG. 3 is a flow chart showing the cooling operation according to Embodiment 1.

When each the target temperature TFa and TRa is set by the target temperature setter 55 after turning on the power source, the operation of the compressor 20 is started, and the control flow of "R and F rooms cooling time control" shown in FIG. 3 is firstly started. First of all, an integrated value B is initialized (step S11), and then a deviation (R room temperature deviation) ΔTR between an actual storage room temperature TR of the R room (the refrigeration room 13R) given at that moment from the R room sensor 51R and a target temperature TR of the R room is calculated (step S12), and next, a deviation (F room temperature deviation) ΔTF between an actual storage room temperature TF of the F room (the freezing room 13F) given at that moment from the F room sensor 51F and a target temperature TF of the F room is also calculated (step S13). Then, "temperature deviation between rooms" (ΔTR−ΔTF) as the difference for each storage room 13F and 13R in the calculated temperature deviations ΔTF and ΔTR of each storage room 13F and 13R is calculated and then integrated as the integrated value B (step S14). It is then judged whether or not one given cycle is ended in a prescribed time in the step S15, and if not, the steps S12 to S14 are repeated until one cycle is ended, so that the integrated value B for one cycle is calculated.

Next, the integrated value B calculated in the step S15 is compared with two values: an upper limit reference value L_UP and a lower limit reference value L_DOWN (the step S16). When the integrated value B is greater than the upper limit reference value L_UP, that means the integrated value of the R room temperature deviation ΔTR is extremely large, and so the R room cooling time ratio RR is increased by 1 step (0.1) from the default value 0.3 (step S17). When the integrated value B is less than the lower limit reference value L_DOWN, that means the integrated value of the R room temperature deviation ΔTR is small whereas the F room temperature deviation ΔTF is oppositely and extremely large, and so the R room cooling time ratio RR is decreased by 1 step (0.1) from the default value 0.3 (step S18), then the integrated value B is initialized (step S19). Here, the process returns to the step S12. Additionally, when the integrated value B settles between the upper limit reference value L_UP and the lower limit reference value L_DOWN, the process returns to the step S12 without changing the R room cooling time ratio RR.

Figure 4:
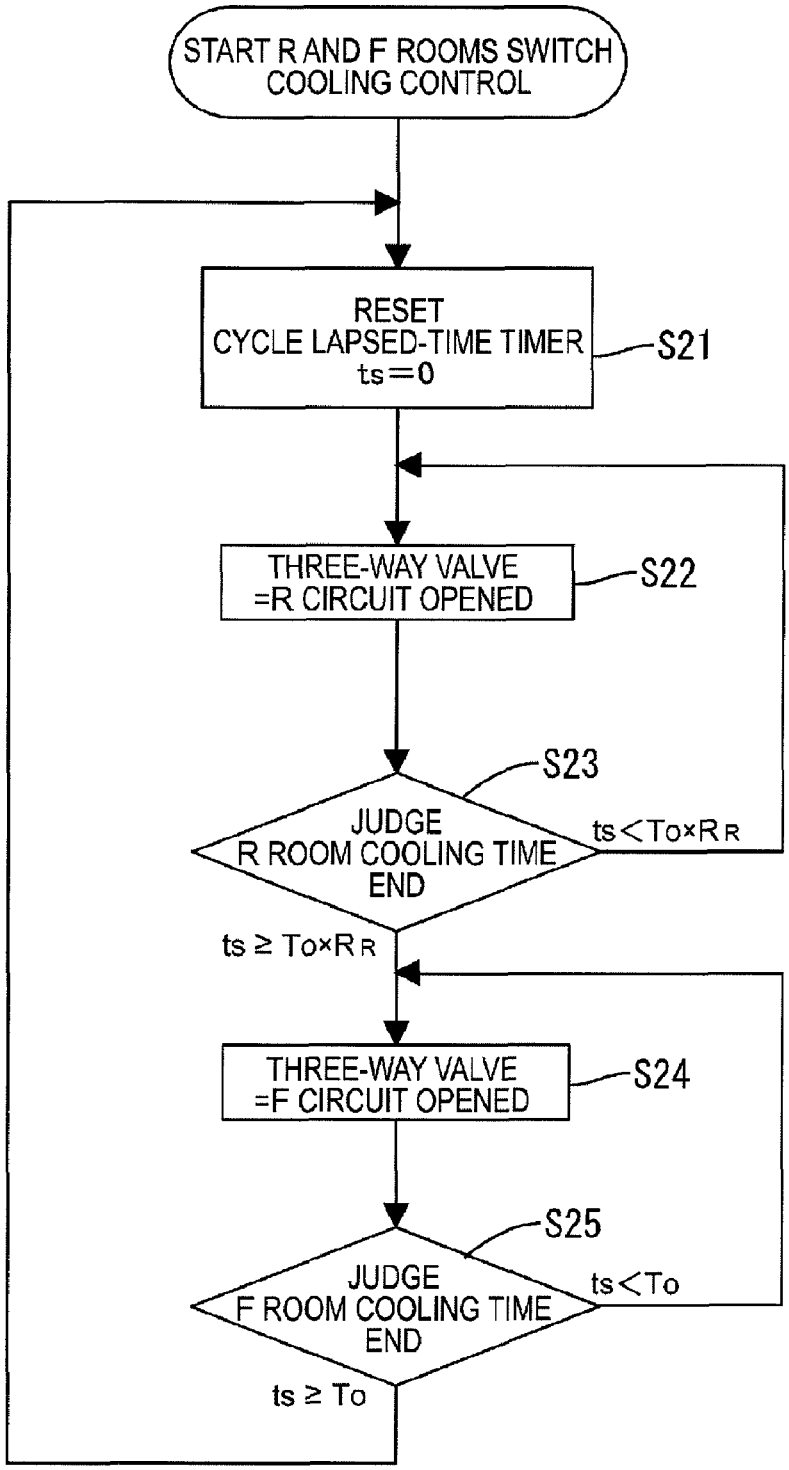
FIG. 4 is a flow chart showing the cooling operation according to Embodiment 1.

Next, when the integrated value B is decided as mentioned above, the control flow of "R and F rooms switch cooling control" as shown in FIG. 4 is executed. Here, a value is of the cycle lapsed-time timer is firstly reset (step S21), and the three-way valve 24 is switched so as to open the refrigeration room 13R side (the side of the second refrigerant flow channel 25R) (step S22), and whether the R room cooling time has passed (step S23) or not is decided. The cooling of the refrigeration room 13R is executed by repeating the steps S22 to S23 until the R room cooling time has passed. In addition, the R room cooling time is calculated by multiplying a prescribed time cycle To (for example, 5 minutes) by the above-mentioned R room cooling time ratio RR.

Then, when the value is of the cycle lapsed-time timer exceeds the value obtained by multiplying the time cycle To by the R room cooling time ratio RR (To×RR), the three-way valve 24 this time is switched so as to open the freezing room 13F side (the side of the first refrigerant flow channel 25F) (step S24). The cooling of the freezing room 13F is executed by repeating the steps S24 to S25 until the time cycle To has passed, and when the time cycle To has passed, the process goes back to the step S21 and repeats the above cycle. As a result, during the lapse of one time cycle To of, for example, 5 minutes, the refrigeration room 13R and the freezing room 13F are alternately cooled, and the cooling time ratio thereof is decided by the R room cooling time ratio RR.

Such alternate cooling mode for alternately cooling the freezing room 13F and the refrigeration room 13R is executed until both the storage rooms 13F and 13R are cooled below the lower limit set temperatures TF(OFF) and TR(OFF) (pull-down operation). As a result, the regular control operation is resumed when both the storage rooms 13F and 13R are cooled down around the set temperatures, and after that, when any one of the detected temperatures TF and TR of the storage rooms 13F and 13R reached higher than their upper limit set temperature TF(ON) and upper limit set temperature TR(ON), the operation of the compressor 20 is restarted so as to move to the cooling mode of that storage room. Additionally, for example, in the refrigeration room cooling mode for cooling the refrigeration room 13R, and when the detected temperature TF of the freezing room 13F simultaneously rises above the upper limit set temperature TF(ON), the cooling mode switches to the alternate cooling mode for alternately cooling both the storage rooms 13F and 13R.

Here, when the ratio of the refrigerant supply time for the refrigeration room 13R and the freezing room 13F is assumed to be decided, it is assumed that the deviations ΔTF and ΔTR between the target temperatures and the actual temperatures of each storage room 13R and 13F are merely monitored so that the storage room of larger one of these deviations ΔTF and ΔTR is cooled for a longer period of time. If so, when, for example, the storage room temperature temporarily rises because the storage room door is opened and allowing the external air to flow thereinto, the refrigerant supply into that storage room immediately increases. It is therefore concerned that the cooling might proceed nonetheless the storage room temperature is in a falling-back trend with the door closed, and thus the present storage room might be excessively cooled. In response to this, the present embodiment obtains a difference between these deviations ΔTF and ΔTR, and performs the control based on the integrated value B obtained by further integrating these deviations. Thus, there is no rapid change in the integrated value B of the temperature deviation even when the storage room temperature temporarily rises, and the cooling ratio may not therefore be changed unnecessarily, thereby achieving a steady cooling control.

[Embodiment 2 ]

In the above-mentioned Embodiment 1, the target temperature setter 55 outputs a signal corresponding to the constant lower limit set temperatures TF(OFF) and TR(OFF) that do not change temporally, and the cooling is controlled with these constant set temperatures as a target in both the pull-down operation for cooling the storage room temperature of each storage room 13F and 13R from the room air temperature zone to around each set temperature and in the afterward control operation for keeping the storage room temperature at a set temperature. However, in Embodiment 2, the target temperature setter is constituted so as to sequentially output a different target temperature with the lapse of time.

In other words, each target temperature of the freezing room 13F and the refrigeration room 13R is provided as a temporal changing mode (in short, a mode for changing the target temperature along with the time t). As the changing mode of the target temperature, there are two kinds: a changing mode of the target temperature at the time of the control operation for cooling a storage object such as foods to a set temperature that has been set by an user, and a changing mode of the target temperature at the time of so-called the pull-down cooling operation for cooling from a temperature considerably higher than the set temperature of the control operation to the temperature zone of the control operation, such as when, for example, installing this refrigerator freezer and turning on the power supply for the first time. Both the changing modes may be expressed by a function having the time t as a variable for each the freezing room 13F and the refrigeration room 13R, and the function may be recorded in a memory device composed of such as for example EPROM. The function recorded in the memory device may be read by such as CPU, and thus a target temperature can be calculated with the lapse of time. In Embodiment 2, other structures are exactly the same as those in Embodiment 1.

Figure 5:
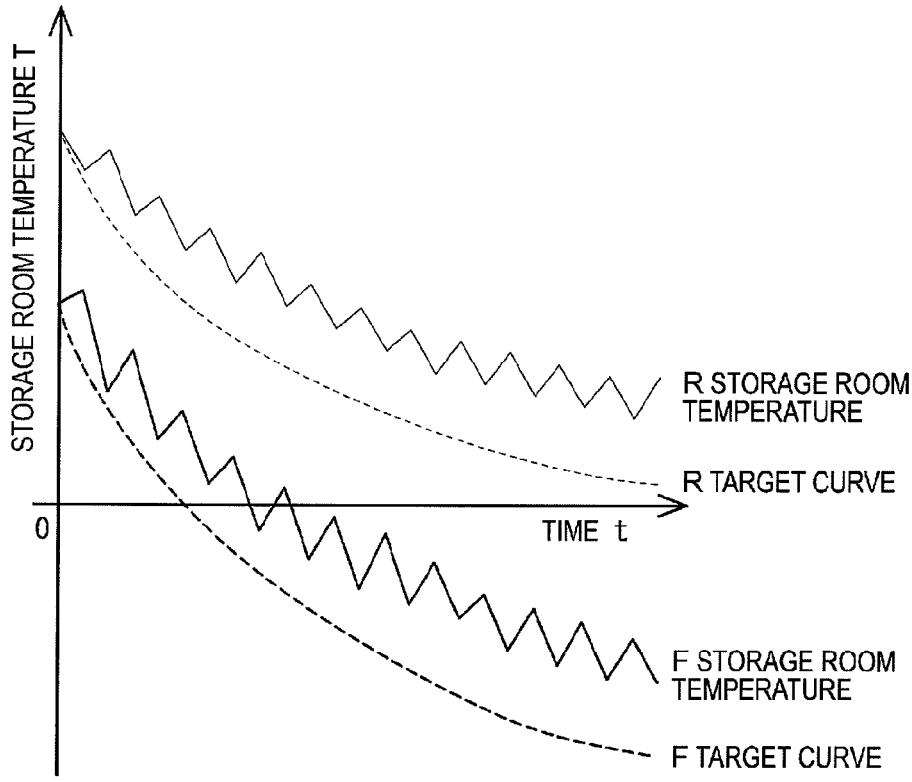
FIG. 5 is a graph showing the temperature change in Embodiment 2 when the cooling performance is insufficient.
Figure 6:
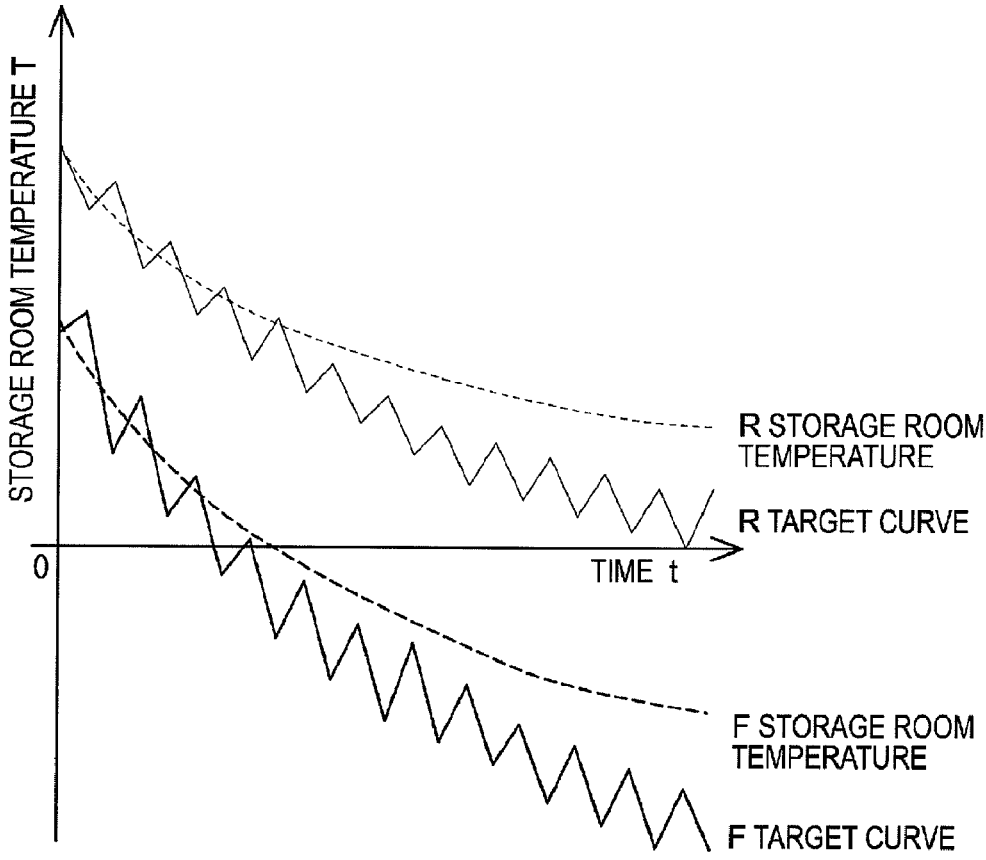
FIG. 6 is a graph showing the temperature change in Embodiment 2 when the cooling performance is excessive.
Figure 7:
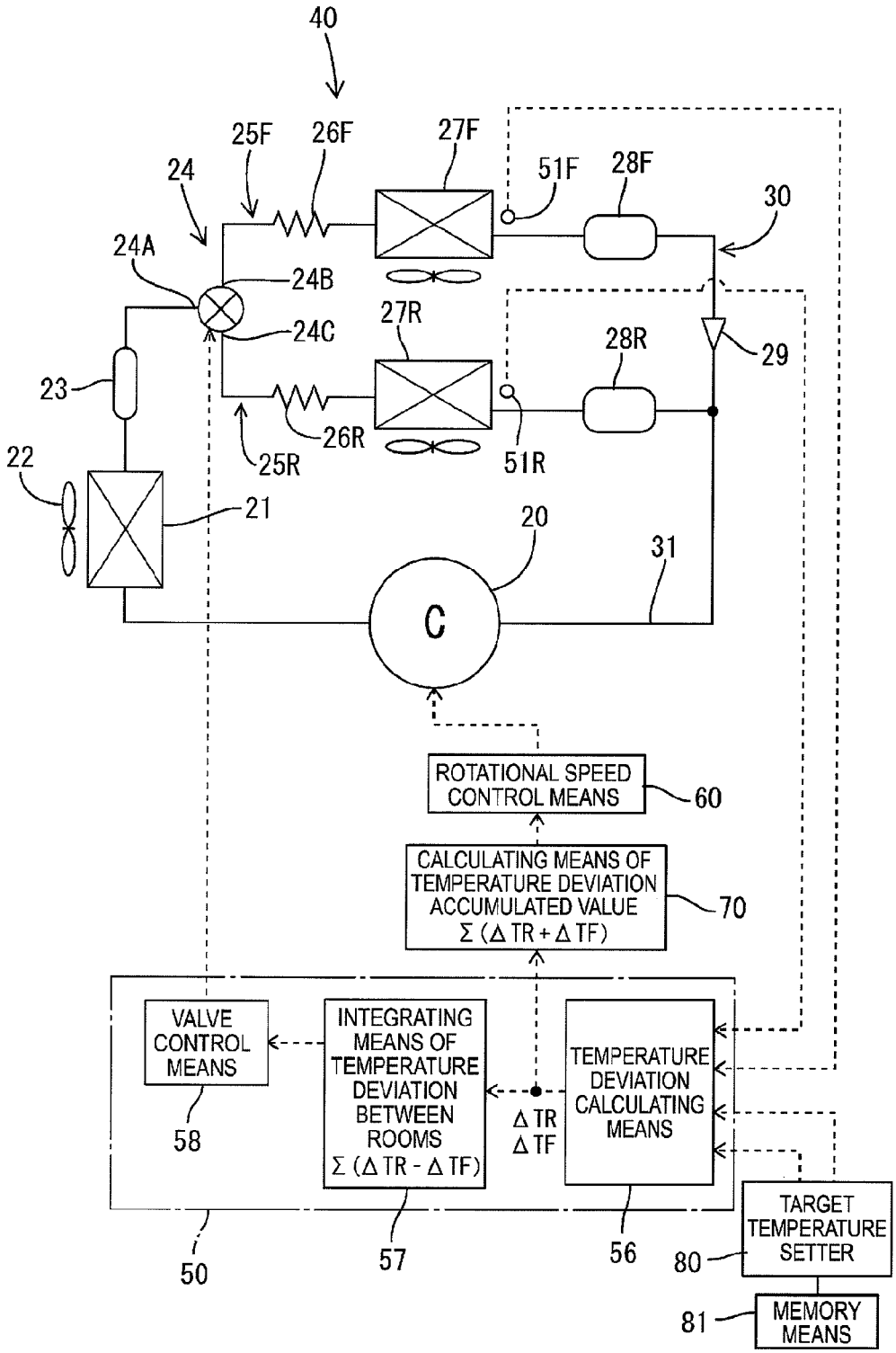
FIG. 7 is a block diagram of a refrigerating cycle according to Embodiment 3.
Figure 8:
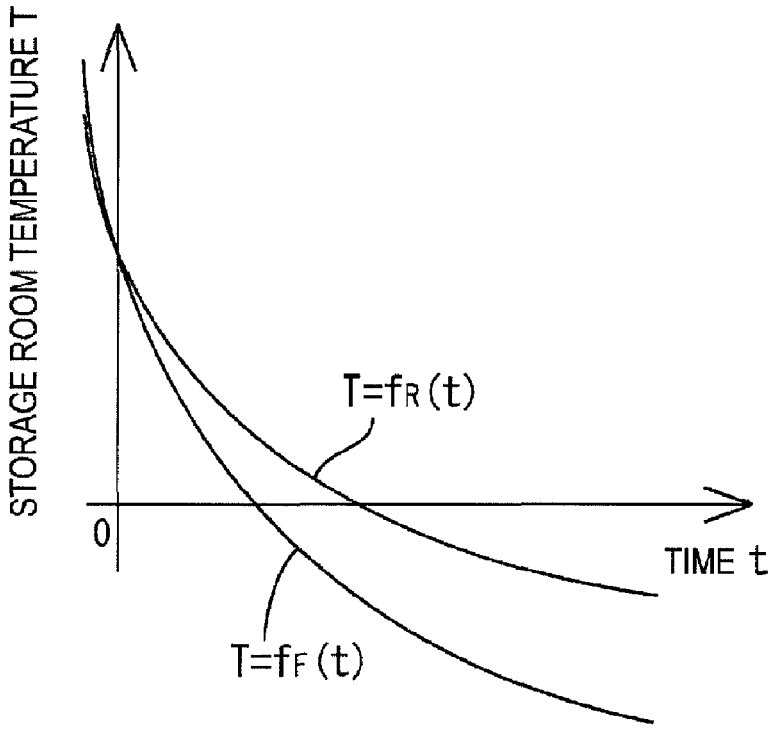
FIG. 8 is a graph showing temporal changing mode of target temperatures of the freezing room and the refrigeration room according to Embodiment 3.

As in Embodiment 2, when the target temperature setter is constituted so as to sequentially output a different target temperature with the lapse of time, target curves R and F of the temperatures should be cooled to can be drawn, for example, as shown in FIG. 5 with dashed lines. When both the storage rooms 13F and 13R are alternately cooled with reference to two target curves as mentioned, the storage room temperatures of the refrigeration room 13R and the freezing room 13F change as shown with straight lines R and F in the same figure. The figure illustrates an example in which the cooling performance of the refrigerating cycle 40 is insufficient for conducting the pull-down cooling of both the storage rooms 13F and 13R simultaneously in accordance with the target curves, whereas FIG. 6 illustrates one in which the cooling performance is oppositely excessive. However, in both cases, even if there is such shortage or excess in the performance, both the storage rooms 13F and 13R can be cooled in a proper balance, without excessive cooling or cooling shortage of one storage room.

[Embodiment 3 ]

In the above Embodiments 1 and 2, the compressor 20 of a fixed speed type is used as example, however, the compressor 20 may be a variable speed type driven by an inverter motor, so that the performance of the refrigerating cycle 40 can be adjusted. An embodiment thereof is described as Embodiment 3 in reference to FIGS. 7 to 10.

In the present embodiment, the difference from the above-mentioned Embodiments 1 and 2 is that the compressor 20 is driven by an inverter motor. The rotational speed of the inverter motor of the compressor 20 is controlled by for example a rotational speed controller 60 that comprises an inverter and outputs an AC of a variable frequency, and the rotational speed controller 60 is given a signal from a temperature deviation accumulated value calculator 70. And also, as in Embodiment 2, a target temperature setter 80 is constituted so as to sequentially output a different target temperature with the lapse of time. Other structures are the same as those in Embodiment 2, and thus, the same numerals are allotted for the same items.

In the target temperature setter 80 in the present Embodiment 3, as mentioned above, each target temperature of the freezing room 13F and the refrigeration room 13R is provided as a temporally changing mode (in short, a mode for changing the target temperature along with the time t), and as the changing mode of the target temperature, there are two kinds: a changing mode of the target temperature at the time of the control operation for cooling a storage object such as foods to a set temperature that has been set by an user, and a changing mode of the target temperature at the time of so-called the pull-down cooling operation for cooling from a temperature considerably higher than the set temperature of the control operation to the temperature zone of the control operation, such as when, for example, installing this refrigerator freezer and turning on the power supply for the first time. Both the changing modes may be expressed by a function having the time t as a variable for each the freezing room 13F and the refrigeration room 13R, and the function is recorded in a memory device 81 composed of such as for example EPROM. For example, the functions TFa=fF(t) and TRa=fR(t) that indicate the changing mode of each target temperature TFa and TRa of the freezing room 13F and the freezing room 13R at the time of the pull-down cooling operation can be illustrated by example in the graph shown in FIG. 8.

Two target temperatures TFa and TRa from the target temperature setter 80 are given to the device temperature deviation calculator 56 along with two storage room temperatures TF and TR obtained from each temperature sensor 51F and 51R, so that the respective temperature deviations ΔTF=(TF−TFa) and ΔTR=(TR−TRa) can be calculated there. Then, the value of each temperature deviation ΔTF and ΔTR is given to the integrator of device temperature deviation between rooms 57 and the temperature deviation accumulated value calculator 70 in the next step. The control of the integrator of device temperature deviation between rooms 57 is the same as the above Embodiment 1, in which the three-way valve 24 is controlled based on the integrated value B so that the refrigeration room 13R and the freezing room 13F are alternately cooled. The cooling time ratio thereof is decided by the R room cooling time ratio RR.

On the other hand, temperature deviation accumulated value calculator 70 decides the rotational speed of the inverter motor, that drives the compressor 20, by performance of the following control.

In short, both the deviations ΔTR and ΔTF are added and integrated for, for example, 2 to 10 minutes (in the present embodiment, 5 minutes), and the value is given to the rotational speed controller 60. In the rotational speed controller 60, an accumulated value A of the deviations is compared with a prescribed reference value (the lower limit and the upper limit values). When the accumulated value A is greater than the upper limit value L_UP, the rotational speed of the inverter motor is increased, whereas when the integrated value A is less than the lower limit value L_DOWN, the rotational speed of the inverter motor is dropped. In addition, the above-mentioned temperature deviation accumulated value calculator 70 and the rotational speed controller 60 are composed of such as CPU for executing a prescribed software, and the processing step of the software is as shown in FIG. 9.

Figure 9:
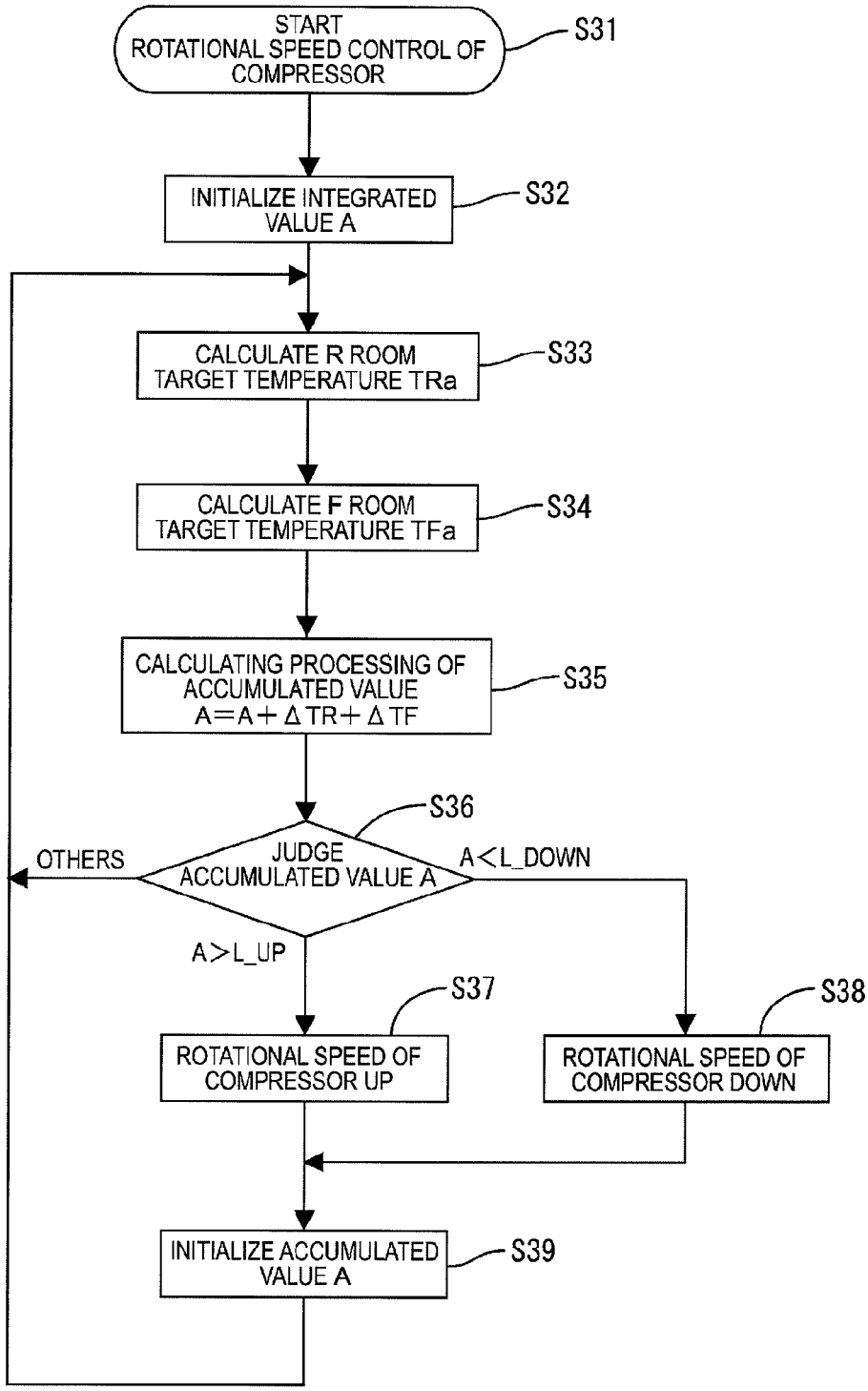
FIG. 9 is a flow chart showing the control procedure of the rotational speed of the compressor according to Embodiment 3.

In reference now to FIG. 9, the software constitution is described. When the start routine of the rotational speed control of the compressor is started by CPU (step S31), the accumulated value A is firstly initialized to, for example, 0 (step S32). Next, a prescribed function is read from the memory device 81 in the target temperature setter 80, and a variable t is assigned to the function (the lapsed time since the start of the present routine), so that each the target temperature TRa and TFa of the refrigeration room 13R and the freezing room 13F is respectively calculated, and while at the same time, the deviation A between these target temperatures TRa and TFa and actual storage temperatures TR and TF is calculated and accumulated (the function of the device temperature deviation calculator 56 and the temperature deviation accumulated value calculator 70: step S5). Then, the accumulated value is compared with the upper limit value L_UP and the lower limit value L_DOWN in the step S36, and the rotational speed of the inverter motor is increased or decreased (the function of the rotational speed controller 60: the steps S36 to S38).

Figure 10:
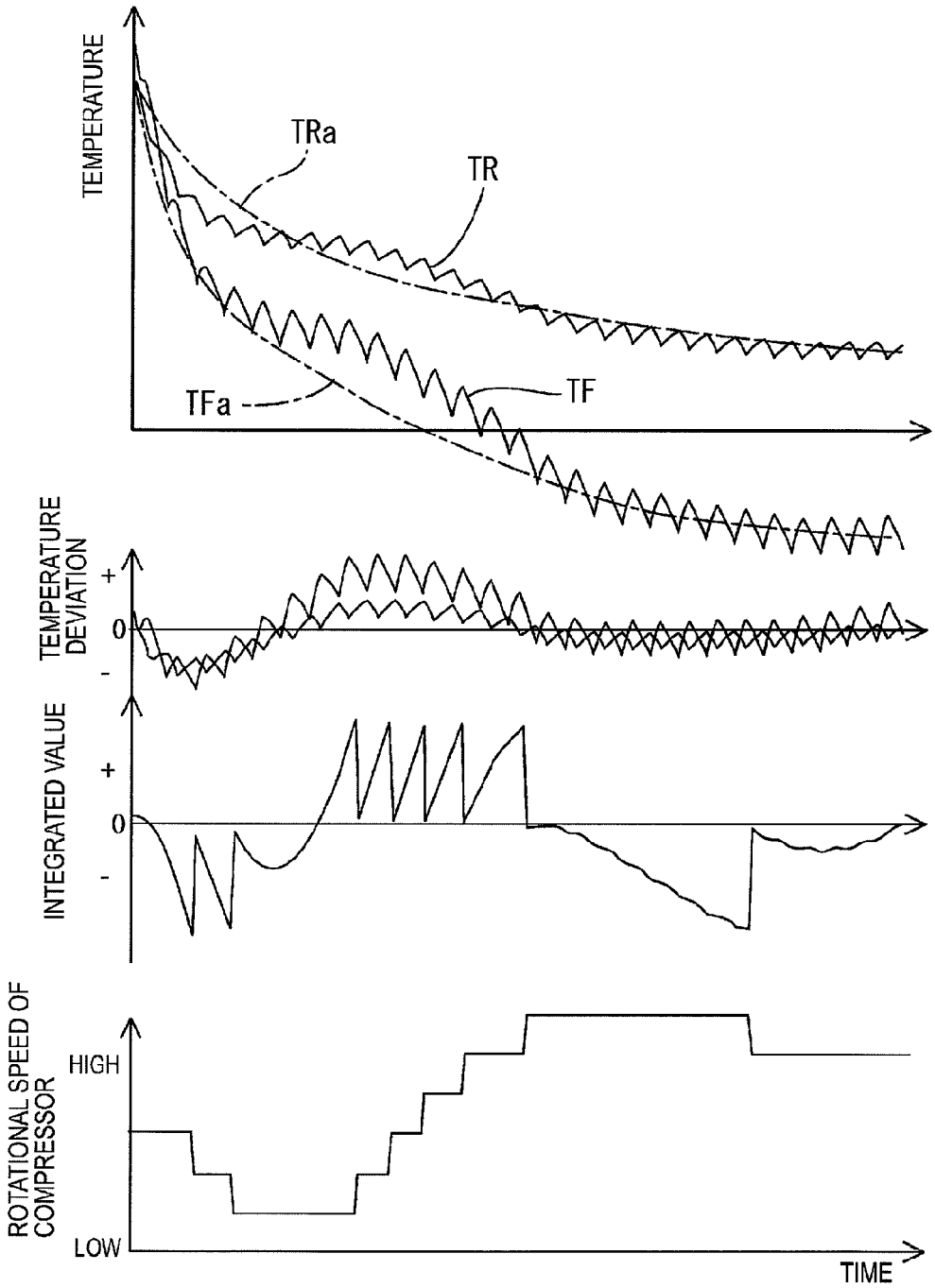
FIG. 10 is a graph showing a relationship between the changing mode of the storage room temperature and the rotational speed of the compressor in the pull-down cooling operation according to Embodiment 3.

According to the present Embodiment 3, in a case where, for example, the temporal changing mode of each the target temperature TRa and TFa of the refrigeration room 13R and the freezing room 13F in the pull-down cooling operation is assumed to be arranged as the graph shown with a dashed-dotted line in FIG. 10, and when the actual storage room temperatures TF and TR of the refrigeration room 13R and the freezing room 13F are assumed to change as shown with the straight lines, for example, the storage room temperature TR of the refrigeration room 13R side is cooled lower than the target temperature TRa at the beginning of the cooling operation, whereas the storage room temperature TF of the freezing room 13F side is cooled so as to reach about the same level as the target temperature TFa. Therefore, the temperature deviation becomes minus, and the accumulated value A also becomes minus. Here, the graph of the accumulated value A has a sawtooth-like waveform because the accumulated value A is initialized in every prescribed time (step S9 in FIG. 9). Since the accumulated value A becomes minus and falls below the lower limit value L_DOWN, the inverter frequency is then gradually lowered at the beginning, and as a result, the rotational speed of the compressor 20 is dropped in a phased manner so as to suppress the cooling performance. Thus, the storage room temperature approaches the lowering level of the target temperature.

As a result of the lowered cooling performance, when the storage room temperature exceeds the target temperature, each temperature deviation of the freezing room 13F and the refrigeration room 13R as well as the accumulated value A shift to plus values. When the total accumulated value A exceeds the upper limit value L_UP, the rotational speed of the compressor is increased so as to enhance the cooling performance, and thus, the storage room temperature again approaches the lowering level of the target temperature. Hereinafter, with repetition of such a control, the storage room temperature lowers in accordance with the predetermined temporal changing mode of the target temperature.

When the heat insulating door of the storage body 10 is opened temporarily in the middle of the pull-down cooling operation as mentioned above, and even when the storage room temperature temporarily rises due to the external air flew thereinto, the room temperature is recovered rapidly by closing the heat insulating door. Therefore, there is no rapid change in the accumulated value A as long as it is monitored as the accumulated value A of the temperature deviation. In this way, the controller 50 performs a steady control without sensitively responding to and rapidly enhancing the rotational speed of the compressor 20, and thereby contributing to electrical power saving.

In the above, a case of the pull-down cooling operation has been described, however, also in the control operation for cooling a storage object such as foods to a set temperature that has been set by an user, the rotational speed of the compressor is controlled in the same way as the pull-down cooling operation with the following previous steps: to decide the upper limit value and the lower limit value having a set temperature there between, and to functionize the changing mode of the target temperature which indicates how the storage room temperature should be changed temporally from the upper limit value toward the lower limit value, and then to store the function in a memory device. Consequently, the control operation does not also respond to the rapid and temporary change in the storage room temperature due to the opening and closing of the heat insulating door, and thereby achieving electrical power saving. In addition, the compressor 20 is controlled so as to follow the changing mode of the stored target temperature, and the operation halt time of the compressor 20 can therefore be accordingly ensured. This means, a sort of defrosting function can be delivered by each cooling device 27F and 27R, and thereby preventing heavy frost formation.

Also, a commercial refrigerator needs the above-mentioned pull-down cooling operation not only in the initial installation of the refrigerator, but also, such as, in restart after the lapse of a few hours from the cutting-off the power supply, opening of the door for a long period of time when delivering a large amount of ingredients, and putting a large amount of ingredients of high temperature right after cooking, and thus, the cooling property is extremely important Considering this, the present embodiment provides the cooling property at the time of the pull-down cooling operation not as a final target value of a mere temperature but as the temporal changing mode of a target temperature, so that a common cooling unit can be used for heat insulating storages of varied modes.

Furthermore, in the present embodiment, when giving a target temperature as the temporal changing mode, it is given as a target temperature in every prescribed time. Thus, as compared to a case where, for example, a target temperature is given as a change ratio of the temperature in every prescribed time, the embodiment can be advantageously applied to a type of a cooling storage which cools two rooms by alternately supplying the refrigerant to two cooling devices 27F and 27R from one compressor 20. In other words, when it is assumed to be constituted that a cooling target is given as a change ratio of temperature in every prescribed time, and when the rotational speed of the compressor 20 is controlled so as to get closer to that change ratio, the alternate cooling type achieves a target change ratio of the cooling operation, because, when the door of one storage room is temporarily opened during the cooling of the other room and its storage room temperature rises, this storage room temperature can be immediately lowered in the subsequent cooling of this storage room with the door closed. Therefore, a situation occurs where, despite the storage room temperature being actually and slightly rising, the rotational speed of the compressor 20 is dropped, and if such a situation is repeated, the storage room temperature cannot be lowered as expected.

In response to this, in the present embodiment, the temporal changing mode of target temperature is given as a target temperature different in every prescribed time (gradually lowering), and therefore, when there is a temporary rise in the storage room temperature, and if the target temperature is not yet achieved at the moment, the rotational speed of the compressor 20 is increased so as to enhance the cooling performance, and thereby certainly lowering the storage room temperature as preset.

[Embodiment 4 ]

As mentioned above, in each of the above embodiments, when a larger thermal load is received in any one of the storage rooms, the refrigerant supply amount to that storage room is immediately increased so as to accelerate the cooling of the storage room of a larger thermal load. This means the cooling performance of the other storage room is decreased, and a rise in the storage room temperature of that storage room may also be concerned. For example, in the case of a refrigerator freezer, when the cooling time ratio of the refrigeration room is temporarily increased with a large load received in the refrigeration room, depending on such as the use condition, it may be possible the frozen foods stored in the freezing room cannot be kept in a frozen state.

Here, in the present Embodiment 4, when increasing the opening ratio of the refrigerant supply channel of one storage room, it is a condition for the valve controller 58 that the storage room temperature of the other room is within a temperature range higher than its set temperature only by a prescribed value. Moreover, in this case, a steady control is possible on condition that such a situation, where the storage room temperature is within a temperature range higher only by a prescribed value, continues for a prescribed time. The configurations other than the valve controller 58 are exactly the same as the above Embodiment 3.

Figure 11:
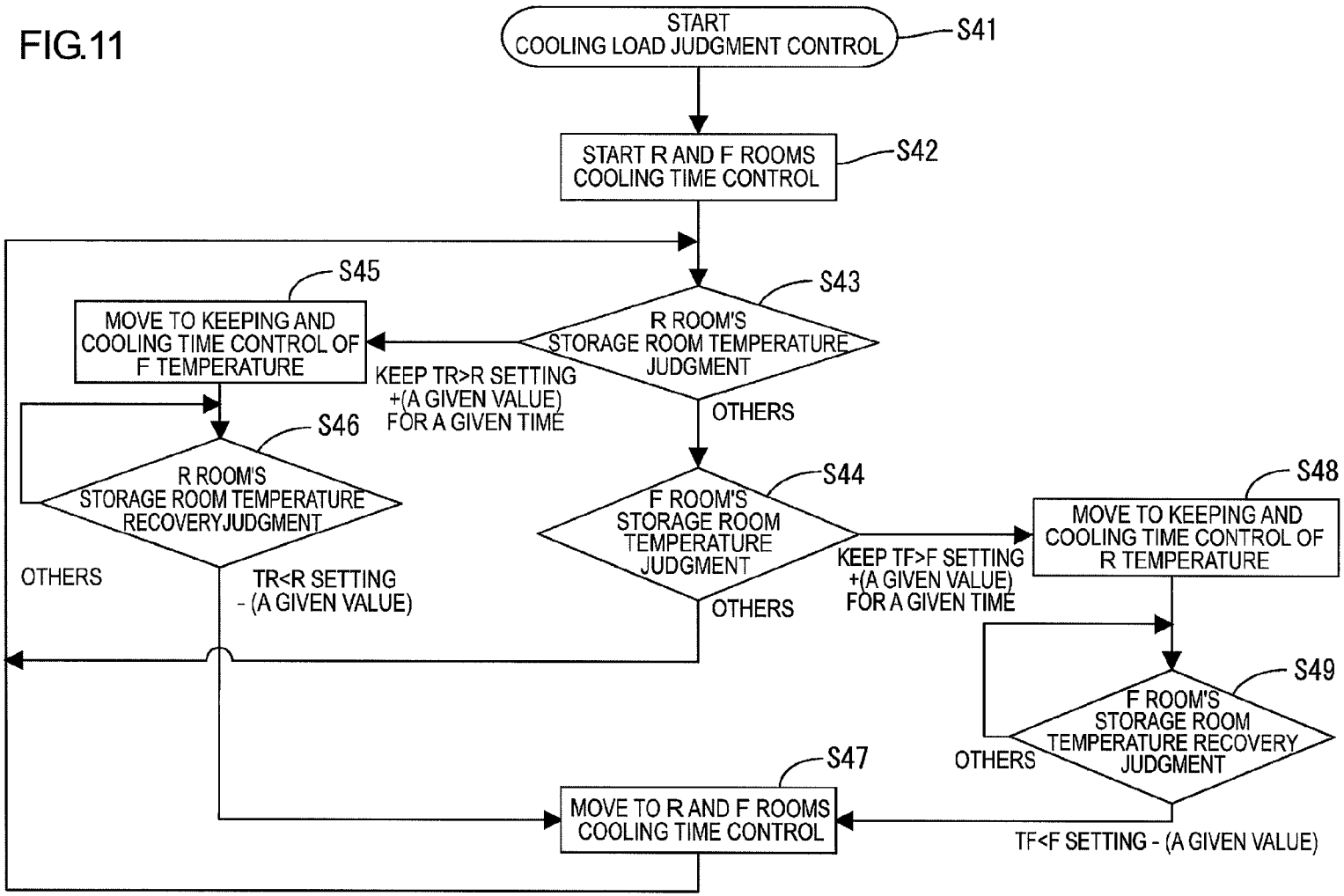
FIG. 11 is a flow chart showing the operation procedure of "cooling load judgment control" according to Embodiment 4.
Figure 12:
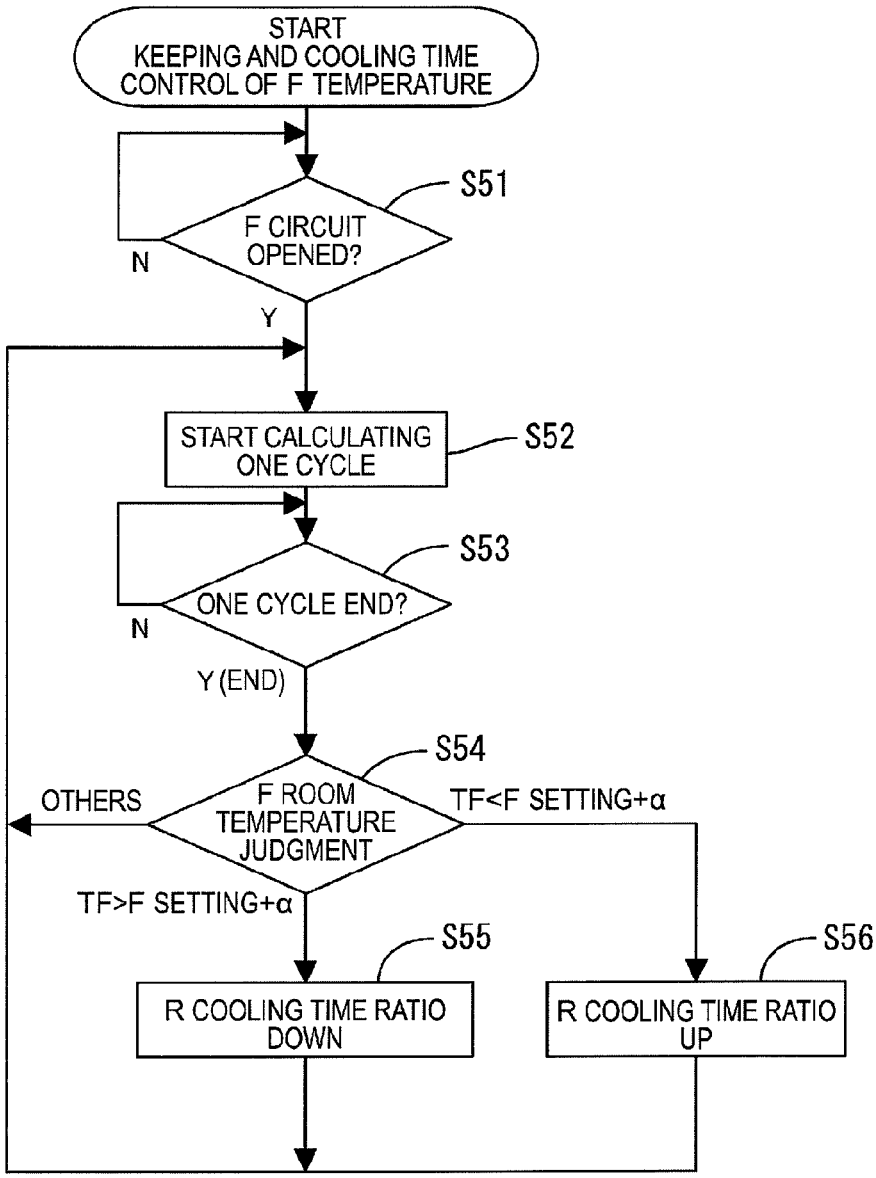
FIG. 12 is a flow chart showing the operation procedure of "keeping and cooling time control of F temperature" according to Embodiment 4.
Figure 13:
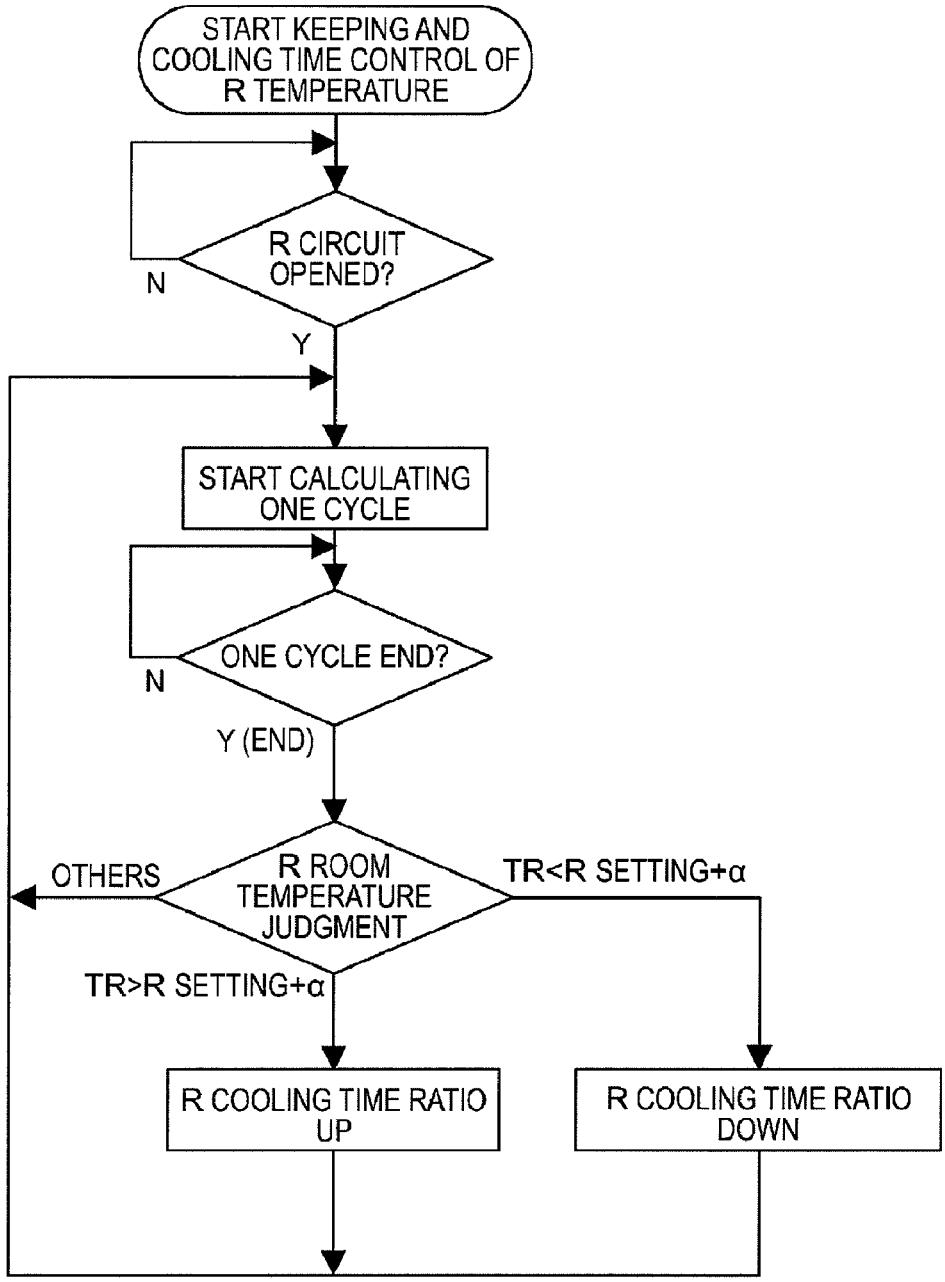
FIG. 13 is a flow chart showing the operation procedure of "keeping and cooling time control of R temperature" according to Embodiment 4.

Next, as referring now to FIGS. 11 to 13, the distinctive motion of the valve controller 58 in the present Embodiment 4 is described in details.

The device temperature deviation calculator 56, the integrator of device temperature deviation between rooms 57, the temperature deviation accumulated value calculator 70 and the rotational speed controller 60 function similarly to the Embodiment 3, and the control of the rotational speed of the compressor 20 and the open/close of the three-way valve 24 acts as mentioned already above. On the other hand, in the present Embodiment 4, "cooling load judgment control" shown in FIG. 11 is also started (step S41). When "cooling load judgment control" is started, "R and F rooms cooling time control" is firstly started as in the step 42. This is the processing as shown in FIG. 4, and being executed simultaneously as "cooling load judgment control" in FIG. 11.

Next, in the step S43, the processing of "R room's storage room temperature judgment" is executed for judging whether or not a state, where the storage room temperature TR of the refrigeration room 13R is exceeding a temperature obtained by adding a prescribed value (for example, 2 degrees) to its set temperature TRa, has continued for a prescribed time (for example, 5 minutes). If not, the process moves to the next step S44. Furthermore, the processing of "F room's storage room temperature judgment" is executed, so as to judge whether or not a state where the storage room temperature TF of the freezing room 13F is exceeding a temperature obtained by adding a prescribed value (for example, 2 degrees) to its set temperature TFa has continued for a prescribed time (for example, 5 minutes). If not, the process moves back to the previous step S43, and repeats the steps from S43 to S44.

In such a state, for example, a relatively large thermal load (such as warm foods) is assumed to be received in the refrigeration room 13R. In response, the storage room temperature of the refrigeration room 13R rises. With such state continued for a relatively long period of time, and when a situation where the storage room temperature is higher than the set temperature TRa for more than 2 degrees therefore continued for more than 5 minutes, the process moves from the step S43 to the step S45, and starts "keeping and cooling time control of F temperature". The step thereof is as shown in FIG. 12, and firstly, waits ready until the three-way valve 24 will be in a opened state of the first refrigerant flow channel 25F for the freezing room 13F (F circuit opened) (step S51). Once F circuit is opened, the process moves to the step S52, and starts time calculation for judging whether or not one cycle of "R and F rooms cooling time control" (see FIG. 3) has finished. When one cycle ended ("Y" in the step S53), "F room temperature judgment" is conducted (step S54). The "F room temperature judgment" judges whether the storage room temperature TF of the freezing room 13F is less than a temperature obtained by adding a prescribed a (for example, a temperature corresponding to the difference between the average value of the storage room temperatures TF and the greatest value thereof) to its set temperature TFa. If TF>TFa+α, the storage room temperature of the freezing room 13F is rising too high. The cooling performance for the freezing room 13F can therefore be judged as being insufficient, and thus, the R cooling time ratio is reduced only by 1 step (step S55). Reversely, if TF<TFa+α, the rise in the storage room temperature of the freezing room 13F is moderate. The cooling performance for the freezing room 13F can therefore be judged as being excessive, and thus, the R cooling time ratio is increased only by 1 step (step S56). If other than the above (in short, TF=TFa+α), the process returns to the step S52 without changing the R cooling time ratio, and repeats the above "F room temperature judgment" in every cycle. As a result, with consideration to the temperature rise of the freezing room 13F in "keeping and cooling time control of F temperature", the refrigeration room 13R is cooled by concentrating the cooling performance to the refrigeration 13R, and thus, the storage room temperature TR of the refrigeration room 13R, into which foods are newly put, is cooled to the set temperature of the refrigeration room. Therefore, even when foods of high temperature is assumed to be put in the refrigeration room 13R, the cooling performance is not one-sidedly directed to the cooling of the foods, and the storage room temperature TF of the freezing room 13F is cooled intensively within a range of TFa+α. Thus, it is surely prevented that the temperature of the freezing room F rises carelessly, causing the frozen foods to defrost.

During such "keeping and cooling time control of F temperature", "R room's storage temperature recovery judgment" is conducted simultaneously (step S46 in FIG. 11), and thus, when the storage room temperature TR of the refrigeration room 13R falls below the set temperature TRa, the process moves to the step S47 and restarts the initial "R and F room cooling time control".

And also, in reverse, when a relatively large thermal load (such as warm foods) is assumed to be received in the freezing room 13F, the storage room temperature TF of the freezing room 13F rises, and this temperature rise maintains for a relatively long period of time. Thus, even when a state where the storage room temperature TF is higher than the set temperature TFa by more than 2 degrees continues for more than 5 minutes, the process moves from the step S44 to the step S48 and starts "keeping and cooling time control of F temperature". This step is as shown in FIG. 13, and its principle is the same as that of the above-mentioned "keeping and cooling time control of F temperature". In other words, when the storage room temperature TR of the refrigeration room 13R is judged whether or not being higher than a temperature obtained by adding a prescribed a (for example, a temperature corresponding to the difference between the average value of the storage room temperatures TR and the greatest value thereof) to its set temperature TRa. If TR>TRa+α, it means the storage room temperature of the refrigeration room 13R has risen too high. This can be judged that the cooling performance for the refrigeration room 13R is insufficient, and thus, the R cooling time ratio is increased only by 1 step. Reversely, if TF<TRa+α, the rise in the storage room temperature of the refrigeration room 13R is moderate. The cooling performance for the refrigeration room 13R can therefore be judged as being excessive, and thus, the R cooling time ratio is decreased only by 1 step.

As a result, with consideration to the temperature rise of the refrigeration room 13R, the freezing room 13F is cooled by concentrating the cooling performance to the freezing room 13F. Therefore, even when foods of high temperature is assumed to be put in the freezing room 13F, the cooling performance is not one-sidedly directed to the cooling for the foods, and the storage room temperature TR of the refrigeration room 13R is cooled intensively within a range of TRa+α. Thus the temperature of the refrigeration room R is surely prevented from rising carelessly.

With embodiments of the present invention described above with reference to the accompanying drawings, it is to be understood that the invention is not limited to those precise embodiments, and the embodiment as below, for example, can be within the scope of the present invention.

(1) In the above embodiment, a cooling storage comprising a freezing room and a refrigeration room is explained by example, however, the present invention is not limited to this, and may be applied to a cooling storage comprising a refrigeration room and a thawing room, or two refrigeration rooms or two freezing rooms of varied storage temperatures. In short, the present invention may be broadly applied to a cooling storage comprising storage rooms of varied thermal loads, wherein a refrigerant is supplied to evaporators disposed in each storage room from a common compressor shared between the evaporators.

(2) In each of the above embodiments, a deviation between the target temperature and the storage room temperature is integrated in every prescribed time, and when the integrated value exceeds a prescribed reference value, the rotational speed of the compressor is immediately increased. However, when deciding the rotational speed of the compressor, other conditions may be added.

Figure 14:
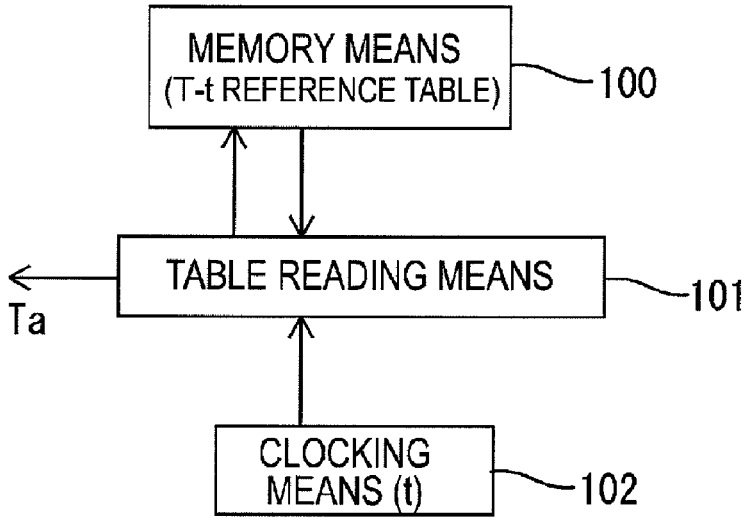
FIG. 14 is a block diagram showing another embodiment which includes a different target temperature setter.

(3) In Embodiment 3, the target temperature setter 80 is constituted so as to record a function expressing the temporal changing mode of the target temperature into the memory device 81 and calculate the target temperature by reading the function stored in the memory device 81 with the lapse of time, however, the present invention is not limited to this. For example, as shown in FIG. 14, a reference table in which the temperature and the lapse of time of the temporal changing mode are contrasted may be prepared and recorded in a memory device 100 beforehand. According to the signal sent from the clocking device 102, the target temperature in the memory device 100 may be read by a table reading device 101 with the lapse of time.

The invention claimed is:

1. A method of operating a cooling storage, comprising: a compressor, a condenser, a valve device, a first and a second evaporators, and a throttle device for throttling the refrigerant flowing into each the evaporator, wherein the refrigerant that has been compressed by the compressor and liquified by the condenser is selectively supplied to the first and the second evaporators by the valve device, so that each of a first and a second storage rooms of varied thermal loads is cooled by the first and the second evaporators, and said method is characterized by calculating and integrating a deviation between a target temperature set for each the first and the second storage room and an actual storage temperature measured in each storage room at every predetermined time, and changing a ratio of refrigerant supply time for each of the first and the second evaporators by controlling the valve device based on the integrated value.

2. A cooling storage comprising:

a refrigerating cycle comprising the following A1 to A6;

(A1) a compressor for compressing a refrigerant (A2) a condenser for releasing heat from the refrigerant compressed by the compressor (A3) a valve device, with its entrance connected with the condenser side while its two exits connected with a first and a second refrigerant supply channels, capable of flow channel switching motion for selectively connecting the entrance side with any one of the first and the second refrigerant supply channels (A4) a first and a second evaporators provided respectively in the first and the second refrigerant supply channels (A5) a throttle device for throttling the refrigerant flowing into each evaporator (A6) a refrigerant circulating channel which connects from the refrigerant exit sides of the first and the second evaporators to the refrigerant sucking side of the compressor a storage body having a first and a second storage rooms of varied thermal loads which are cooled with cold air produced by the first and the second evaporators, a target temperature setter for setting a target temperature for each of the first and second storage rooms, a first and a second temperature sensors for detecting a storage room temperature in each storage room, a device temperature deviation calculator for calculating for each storage room a temperature deviation as a difference between each target temperature of each storage room set in the target temperature setter and a storage room temperature of each storage room detected by each temperature sensor, an integrator of device temperature deviation between rooms for calculating and integrating a temperature deviation between rooms as a difference for every storage room with respect to the temperature deviation calculated by the device temperature deviation calculator, and a valve controller for changing an opening ratio of each of the first and the second refrigerant supply channels in the valve device by comparing an integrated value integrated by the integrator of device temperature deviation between rooms with a reference value.

3. A cooling storage according to claim 2, wherein, when increasing an opening ratio of the refrigerant supply channel of one storage room, it is a condition for the valve controller that the storage room temperature of the other room is within a temperature range higher than its set temperature only by a prescribed value.

4. A cooling storage according to claim 3, wherein, when increasing an opening ratio of the refrigerant supply channel of one storage room, it is a condition for the valve controller that the storage room temperature of the other room is within a prescribed temperature range relative to its set temperature continuously for a prescribed time.

5. The cooling storage according to claim 2, wherein the target temperature setter is constituted so as to sequentially output a different target temperature with the lapse of time.

6. The cooling storage according to claim 5, wherein the target temperature setter comprises a memory device for storing a function expressing the temporal changing mode of a target temperature and a target temperature calculator for calculating a target temperature by reading the function stored in the memory device with the lapse of time.

7. The cooling storage according to claim 5, wherein the target temperature setter comprises a memory device for storing the temporal changing mode of a target temperature as a reference table in which the temperature and the lapse of time is contrasted, and a table reading device for reading a target temperature in the memory device with the lapse of time.

8. The cooling storage according to claim 3, wherein the target temperature setter is constituted so as to sequentially output a different target temperature with the lapse of time.

9. The cooling storage according to claim 4, wherein the target temperature setter is constituted so as to sequentially output a different target temperature with the lapse of time.

10. A cooling storage, comprising:

a refrigerating cycle comprising the following A1 to A6;

(A1) a compressor driven by an inverter motor for compressing a refrigerant (A2) a condenser for releasing heat from the refrigerant compressed by the compressor (A3) a valve device, with its entrance connected with the condenser side while its two exits connected with a first and a second refrigerant supply channels, capable of flow channel switching motion for selectively connecting the entrance side with any one of the first and the second refrigerant supply channels (A4) a first and a second evaporators provided respectively in the first and the second refrigerant supply channels (A5) a throttle device for throttling the refrigerant flowing into each evaporator (A6) a refrigerant circulating channel which connects from the refrigerant exit sides of the first and the second evaporators to the refrigerant sucking side of the compressor a storage body having a first and a second storage rooms of varied thermal loads which are cooled with cold air produced by the first and the second evaporators, a target temperature setter for setting a target temperature for each of the first and second storage rooms, a first and a second temperature sensors for detecting a storage room temperature in each storage room, a device temperature deviation calculator for calculating for each storage room a temperature deviation as a difference between each target temperature of each storage room set in the target temperature setter and a storage room temperature of each storage room detected by each temperature sensor, an integrator of device temperature deviation between rooms for calculating and integrating a temperature deviation between rooms as a difference for every storage room with respect to the temperature deviation calculated by the device temperature deviation calculator, a valve controller for changing an opening ratio of each of the first and the second refrigerant supply channels in the valve device by comparing an integrated value integrated by the integrator of device temperature deviation between rooms with a reference value, a temperature deviation accumulated value calculator for calculating a temperature deviation accumulated value as an accumulated value of the sum of every storage room with respect to a temperature deviation calculated by the device temperature deviation calculator, and a rotational speed controller for changing the rotational speed of the inverter motor by comparing an accumulated value calculated by the temperature deviation accumulated value calculator with a reference value.

11. A cooling storage according to claim 10, wherein, when increasing an opening ratio of the refrigerant supply channel of one storage room, it is a condition for the valve controller that the storage room temperature of the other room is within a temperature range higher than its set temperature only by a prescribed value.

12. A cooling storage according to claim 11, wherein, when increasing the opening ratio of the refrigerant supply channel of one storage room, it is a condition for the valve controller that the storage room temperature of the other room is within a prescribed temperature range relative to its set temperature continuously for a prescribed time.

13. The cooling storage according to claim 10, wherein the target temperature setter is constituted so as to sequentially output a different target temperature with the lapse of time.

14. The cooling storage according to claim 11, wherein the target temperature setter is constituted so as to sequentially output a different target temperature with the lapse of time.

15. The cooling storage according to claim 12, wherein the target temperature setter is constituted so as to sequentially output a different target temperature with the lapse of time.

* * * * *